US007229338B2

(12) United States Patent
Agarwal

(10) Patent No.: US 7,229,338 B2
(45) Date of Patent: Jun. 12, 2007

(54) APPARATUSES AND METHODS FOR IN-SITU OPTICAL ENDPOINTING ON WEB-FORMAT PLANARIZING MACHINES IN MECHANICAL OR CHEMICAL-MECHANICAL PLANARIZATION OF MICROELECTRONIC-DEVICE SUBSTRATE ASSEMBLIES

(75) Inventor: Vishnu K. Agarwal, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/197,287

(22) Filed: Aug. 3, 2005

(65) Prior Publication Data

US 2005/0266773 A1 Dec. 1, 2005

Related U.S. Application Data

(62) Division of application No. 10/624,382, filed on Jul. 21, 2003, now Pat. No. 6,986,700, which is a division of application No. 09/589,380, filed on Jun. 7, 2000, now Pat. No. 6,612,901.

(51) Int. Cl.
*B24B 49/00* (2006.01)
*B24B 51/00* (2006.01)

(52) U.S. Cl. ..... 451/6; 451/8; 451/296

(58) Field of Classification Search ..... 451/5, 451/6, 8, 9, 10, 11, 297, 527, 296; 216/88, 216/89; 438/692, 693
See application file for complete search history.

(56) References Cited

U.S. PATENT DOCUMENTS 4,145,703 A 3/1979 Blanchard et al.

(Continued)

FOREIGN PATENT DOCUMENTS

| | | | |
|---|---|---|---|
| EP | 0 623 423 | A1 | 11/1994 |
| JP | 2004-363229 | A | 12/2004 |
| WO | WO-99/56078 | A1 | 11/1999 |
| WO | WO-01/04221 | A1 | 1/2001 |
| WO | WO-01/64430 | A1 | 9/2001 |

OTHER PUBLICATIONS

Applied Materials, Inc., 2002, "Mira Mesa Advanced Integrated CMP," Applied Materials. Products. CMP. Mirra Mesa CMP, (2 pages).

(Continued)

*Primary Examiner*—Timothy V. Eley
(74) *Attorney, Agent, or Firm*—Perkins Coie LLP

(57) ABSTRACT

Planarizing machines, planarizing pads, and methods for planarizing or endpointing mechanical and/or chemical-mechanical planarization of microelectronic substrates. One particular embodiment is a planarizing machine that controls the movement of a planarizing pad along a pad travel path to provide optical analysis of a substrate assembly during a planarizing cycle. The planarizing machine can include a table having an optical opening at an illumination site in a planarizing zone and a light source aligned with the illumination site to direct a light beam through the optical opening in the table. The planarizing machine can further include a planarizing pad and a pad advancing mechanism. The planarizing pad has a planarizing medium and at least one optically transmissive window along the pad travel path. The pad advancing mechanism has an actuator system coupled to the pad and a position monitor coupled to the actuator system. The actuator system is configured to move the planarizing pad over the table along the pad travel path, and the position monitor is configured to sense the position of a window in the planarizing pad relative to the opening in the table at the illumination site.

14 Claims, 7 Drawing Sheets

U.S. PATENT DOCUMENTS

| | | | |
|---|---|---|---|
| 4,200,395 | A | 4/1980 | Smith et al. |
| 4,203,799 | A | 5/1980 | Sugawara et al. |
| 4,305,760 | A | 12/1981 | Trudel |
| 4,358,338 | A | 11/1982 | Downey et al. |
| 4,367,044 | A | 1/1983 | Booth, Jr. et al. |
| 4,377,028 | A | 3/1983 | Imahashi |
| 4,422,764 | A | 12/1983 | Eastman |
| 4,498,345 | A | 2/1985 | Dyer et al. |
| 4,501,258 | A | 2/1985 | Dyer et al. |
| 4,502,459 | A | 3/1985 | Dyer |
| 4,640,002 | A | 2/1987 | Phillips et al. |
| 4,660,980 | A | 4/1987 | Takabayashi et al. |
| 4,717,255 | A | 1/1988 | Ulbers |
| 4,755,058 | A | 7/1988 | Shaffer |
| 4,879,258 | A | 11/1989 | Fisher |
| 4,946,550 | A | 8/1990 | Van Laarhoven |
| 4,971,021 | A | 11/1990 | Kubotera et al. |
| 5,020,283 | A | 6/1991 | Tuttle |
| 5,036,015 | A | 7/1991 | Sandhu et al. |
| 5,069,002 | A | 12/1991 | Sandhu et al. |
| 5,081,796 | A | 1/1992 | Schultz |
| 5,163,334 | A | 11/1992 | Li et al. |
| 5,196,353 | A | 3/1993 | Sandhu et al. |
| 5,220,405 | A | 6/1993 | Barbee et al. |
| 5,222,329 | A | 6/1993 | Yu |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,314,843 | A | 5/1994 | Yu et al. |
| 5,324,381 | A | 6/1994 | Nishiguchi |
| 5,369,488 | A | 11/1994 | Morokuma |
| 5,393,624 | A | 2/1995 | Ushijima |
| 5,413,941 | A | 5/1995 | Koos et al. |
| 5,421,769 | A | 6/1995 | Schultz et al. |
| 5,433,649 | A | 7/1995 | Nishida |
| 5,433,651 | A | 7/1995 | Lustig et al. |
| 5,438,879 | A | 8/1995 | Reda |
| 5,439,551 | A | 8/1995 | Meikle et al. |
| 5,449,314 | A | 9/1995 | Meikle et al. |
| 5,461,007 | A | 10/1995 | Kobayashi |
| 5,465,154 | A | 11/1995 | Levy |
| 5,486,129 | A | 1/1996 | Sandhu et al. |
| 5,499,733 | A | 3/1996 | Litvak |
| 5,514,245 | A | 5/1996 | Doan et al. |
| 5,533,924 | A | 7/1996 | Stroupe et al. |
| 5,540,810 | A | 7/1996 | Sandhu et al. |
| 5,573,442 | A | 11/1996 | Morita et al. |
| 5,609,718 | A | 3/1997 | Meikle |
| 5,616,069 | A | 4/1997 | Walker et al. |
| 5,618,381 | A | 4/1997 | Doan et al. |
| 5,618,447 | A | 4/1997 | Sandhu |
| 5,624,303 | A | 4/1997 | Robinson |
| 5,632,666 | A | 5/1997 | Peratello et al. |
| 5,643,044 | A | 7/1997 | Lund |
| 5,643,048 | A | 7/1997 | Iyer |
| 5,643,060 | A | 7/1997 | Sandhu et al. |
| 5,645,471 | A | 7/1997 | Strecker |
| 5,645,682 | A | 7/1997 | Skrovan |
| 5,650,619 | A | 7/1997 | Hudson |
| 5,655,951 | A | 8/1997 | Meikle et al. |
| 5,658,183 | A | 8/1997 | Sandhu et al. |
| 5,658,190 | A | 8/1997 | Wright et al. |
| 5,663,797 | A | 9/1997 | Sandhu |
| 5,664,988 | A | 9/1997 | Stroupe et al. |
| 5,667,424 | A | 9/1997 | Pan |
| 5,668,061 | A | 9/1997 | Herko et al. |
| 5,679,065 | A | 10/1997 | Henderson |
| 5,681,204 | A | 10/1997 | Kawaguchi et al. |
| 5,681,423 | A | 10/1997 | Sandhu et al. |
| 5,690,540 | A | 11/1997 | Elliott et al. |
| 5,698,455 | A | 12/1997 | Meikle et al. |
| 5,700,180 | A | 12/1997 | Sandhu et al. |
| 5,702,292 | A | 12/1997 | Brunelli et al. |
| 5,708,506 | A | 1/1998 | Birang |
| 5,725,417 | A | 3/1998 | Robinson |
| 5,730,642 | A | 3/1998 | Sandhu et al. |
| 5,736,427 | A | 4/1998 | Henderson |
| 5,738,562 | A | 4/1998 | Doan et al. |
| 5,738,567 | A | 4/1998 | Manzonie et al. |
| 5,747,386 | A | 5/1998 | Moore |
| 5,777,739 | A | 7/1998 | Sandhu et al. |
| 5,779,522 | A | 7/1998 | Walker et al. |
| 5,782,675 | A | 7/1998 | Southwick |
| 5,791,969 | A | 8/1998 | Lund |
| 5,792,709 | A | 8/1998 | Robinson et al. |
| 5,795,218 | A | 8/1998 | Doan et al. |
| 5,795,495 | A | 8/1998 | Meikle |
| 5,798,302 | A | 8/1998 | Hudson et al. |
| 5,801,066 | A | 9/1998 | Meikle |
| 5,807,165 | A | 9/1998 | Uzoh et al. |
| 5,823,855 | A | 10/1998 | Robinson |
| 5,830,806 | A | 11/1998 | Hudson et al. |
| 5,842,909 | A | 12/1998 | Sandhu et al. |
| 5,851,135 | A | 12/1998 | Sandhu et al. |
| 5,855,804 | A | 1/1999 | Walker |
| 5,856,336 | A | 1/1999 | Fujikawa et al. |
| 5,865,665 | A | 2/1999 | Yueh |
| 5,868,896 | A | 2/1999 | Robinson et al. |
| 5,871,392 | A | 2/1999 | Meikle et al. |
| 5,879,222 | A | 3/1999 | Robinson |
| 5,879,226 | A | 3/1999 | Robinson |
| 5,882,244 | A | 3/1999 | Hiyama et al. |
| 5,882,248 | A | 3/1999 | Wright et al. |
| 5,893,754 | A | 4/1999 | Robinson et al. |
| 5,893,796 | A | 4/1999 | Birang et al. |
| 5,894,852 | A | 4/1999 | Gonzales et al. |
| 5,895,550 | A | 4/1999 | Andreas |
| 5,899,792 | A | 5/1999 | Yagi |
| 5,910,043 | A | 6/1999 | Manzonie et al. |
| 5,910,846 | A | 6/1999 | Sandhu |
| 5,930,699 | A | 7/1999 | Bhatia |
| 5,934,973 | A | 8/1999 | Boucher et al. |
| 5,934,974 | A | 8/1999 | Tzeng |
| 5,934,980 | A | 8/1999 | Koos et al. |
| 5,936,733 | A | 8/1999 | Sandhu et al. |
| 5,938,801 | A | 8/1999 | Robinson |
| 5,945,347 | A | 8/1999 | Wright |
| 5,949,927 | A | 9/1999 | Tang |
| 5,954,912 | A | 9/1999 | Moore |
| 5,967,030 | A | 10/1999 | Blalock |
| 5,969,805 | A | 10/1999 | Johnson et al. |
| 5,972,715 | A | 10/1999 | Celentano et al. |
| 5,972,792 | A | 10/1999 | Hudson |
| 5,976,000 | A | 11/1999 | Hudson |
| 5,980,363 | A | 11/1999 | Meikle et al. |
| 5,981,396 | A | 11/1999 | Robinson et al. |
| 5,989,470 | A | 11/1999 | Doan et al. |
| 5,994,224 | A | 11/1999 | Sandhu et al. |
| 5,997,384 | A | 12/1999 | Blalock |
| 6,000,996 | A | 12/1999 | Fujiwara |
| 6,006,739 | A | 12/1999 | Akram et al. |
| 6,007,408 | A | 12/1999 | Sandhu |
| 6,036,586 | A | 3/2000 | Ward |
| 6,039,633 | A | 3/2000 | Chopra |
| 6,040,111 | A | 3/2000 | Karasawa et al. |
| 6,040,245 | A | 3/2000 | Sandhu et al. |
| 6,045,439 | A | 4/2000 | Birang et al. |
| 6,046,111 | A | 4/2000 | Robinson |
| 6,054,015 | A | 4/2000 | Brunelli et al. |
| 6,057,602 | A | 5/2000 | Hudson et al. |

6,066,030 A 5/2000 Uzoh
6,068,539 A 5/2000 Bajaj et al.
6,074,286 A 6/2000 Ball
6,075,606 A 6/2000 Doan
6,077,147 A 6/2000 Yang et al.
6,083,085 A 7/2000 Lankford
6,102,775 A 8/2000 Ushio et al.
6,104,448 A 8/2000 Doane et al.
6,106,351 A 8/2000 Raina et al.
6,106,662 A 8/2000 Bibby, Jr. et al.
6,108,091 A 8/2000 Pecen et al.
6,108,092 A 8/2000 Sandhu
6,110,820 A 8/2000 Sandhu et al.
6,114,706 A 9/2000 Meikle et al.
6,116,988 A 9/2000 Ball
6,120,354 A 9/2000 Koos et al.
6,124,207 A 9/2000 Robinson et al.
6,135,856 A 10/2000 Tjaden et al.
6,139,402 A 10/2000 Moore
6,143,123 A 11/2000 Robinson et al.
6,143,155 A 11/2000 Adams et al.
6,146,248 A 11/2000 Jairath et al.
6,152,803 A 11/2000 Boucher et al.
6,152,808 A 11/2000 Moore
6,165,937 A 12/2000 Puckett et al.
6,176,992 B1 1/2001 Talieh
6,179,709 B1 1/2001 Redeker et al.
6,180,525 B1 1/2001 Morgan
6,184,571 B1 2/2001 Moore
6,186,870 B1 2/2001 Wright et al.
6,187,681 B1 2/2001 Moore
6,190,234 B1 2/2001 Swedek et al.
6,190,494 B1 2/2001 Dow
6,191,037 B1 2/2001 Robinson et al.
6,191,864 B1 2/2001 Sandhu
6,193,588 B1 2/2001 Carlson et al.
6,200,901 B1 3/2001 Hudson et al.
6,203,404 B1 3/2001 Joslyn et al.
6,203,407 B1 3/2001 Robinson
6,203,413 B1 3/2001 Skrovan
6,206,679 B1 3/2001 Provost et al.
6,206,754 B1 3/2001 Moore
6,206,756 B1 3/2001 Chopra et al.
6,206,759 B1 3/2001 Agarwal et al.
6,206,769 B1 3/2001 Walker
6,208,425 B1 3/2001 Sandhu et al.
6,210,257 B1 4/2001 Carlson
6,213,845 B1 4/2001 Elledge
6,218,316 B1 4/2001 Marsh
6,224,466 B1 5/2001 Walker et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,238,270 B1 5/2001 Robinson
6,238,273 B1 5/2001 Southwick
6,241,593 B1 6/2001 Chen et al.
6,244,944 B1 6/2001 Elledge
6,247,998 B1 6/2001 Wiswesser et al.
6,250,994 B1 6/2001 Chopra et al.
6,251,785 B1 6/2001 Wright
6,254,459 B1 7/2001 Bajaj et al.
6,261,151 B1 7/2001 Sandhu et al.
6,261,163 B1 7/2001 Walker et al.
6,264,533 B1 7/2001 Kummeth et al.
6,267,650 B1 7/2001 Hembree
6,271,139 B1 8/2001 Alwan et al.
6,273,101 B1 8/2001 Gonzales et al.
6,273,786 B1 8/2001 Chopra et al.
6,273,796 B1 8/2001 Moore
6,273,800 B1 8/2001 Walker et al.
6,276,996 B1 8/2001 Chopra
6,284,660 B1 9/2001 Doan
6,287,879 B1 9/2001 Gonzales et al.
6,290,572 B1 9/2001 Hofmann
6,296,557 B1 10/2001 Walker
6,301,006 B1 10/2001 Doan
6,306,008 B1 10/2001 Moore
6,306,012 B1 10/2001 Sabde
6,306,014 B1 10/2001 Walker et al.
6,306,768 B1 10/2001 Klein
6,309,282 B1 10/2001 Wright et al.
6,312,558 B2 11/2001 Moore
6,313,038 B1 11/2001 Chopra et al.
6,319,420 B1 11/2001 Dow
6,323,046 B1 11/2001 Agarwal
6,325,702 B2 12/2001 Robinson
6,328,632 B1 12/2001 Chopra
6,331,135 B1 12/2001 Sabde et al.
6,331,139 B2 12/2001 Walker et al.
6,331,488 B1 12/2001 Doan et al.
6,332,831 B1 12/2001 Shemo et al.
6,338,667 B2 1/2002 Sandhu et al.
6,350,180 B2 2/2002 Southwick
6,350,691 B1 2/2002 Lankford
6,352,466 B1 3/2002 Moore
6,352,470 B2 3/2002 Elledge
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,417 B2 3/2002 Walker et al.
6,362,105 B1 3/2002 Moore
6,364,746 B2 4/2002 Moore
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde
6,383,934 B1 5/2002 Sabde et al.
6,387,289 B1 5/2002 Wright
6,395,130 B1 5/2002 Adams et al.
6,395,620 B1 5/2002 Pan et al.
6,402,884 B1 6/2002 Robinson et al.
6,425,801 B1 7/2002 Takeishi et al.
6,426,232 B1 7/2002 Litvak
6,428,386 B1 8/2002 Bartlett
6,447,369 B1 9/2002 Moore
6,498,101 B1 12/2002 Wang
6,511,576 B2 1/2003 Klein
6,520,834 B1 2/2003 Marshall
6,524,164 B1 2/2003 Tolles
6,533,893 B2 3/2003 Sabde et al.
6,537,133 B1 3/2003 Birang et al.
6,537,144 B1 3/2003 Tsai et al.
6,547,640 B2 4/2003 Hofmann
6,548,407 B1 4/2003 Chopra et al.
6,579,799 B2 6/2003 Chopra et al.
6,592,443 B1 7/2003 Kramer et al.
6,609,947 B1 8/2003 Moore
6,609,952 B1 8/2003 Simon
6,612,901 B1 9/2003 Agarwal
6,621,584 B2 * 9/2003 Pecen et al. ..... 356/630
6,623,329 B1 9/2003 Moore
6,628,410 B2 9/2003 Doan
6,629,874 B1 10/2003 Halley
6,633,084 B1 10/2003 Sandhu et al.
6,652,764 B1 11/2003 Blalock
6,666,749 B2 12/2003 Taylor
6,813,824 B2 11/2004 Hasegawa et al.
6,876,454 B1 * 4/2005 Birang et al. ..... 356/503
6,922,253 B2 7/2005 Moore
2001/0012539 A1 8/2001 Barnard et al.

2004/0014396 A1 1/2004 Elledge
2004/0029490 A1 2/2004 Agarwal
2005/0090105 A1 4/2005 Elledge

OTHER PUBLICATIONS

Applied Materials, Inc., 2002, "About the CMP Process," Applied Materials. Products. CMP. About the CMP Process, (1 page).

Banaszak, D. et al., "Visual Crack Measurement System Uses Temperature-Sensitive Paint," Reference document VA-00-01, 5 pages, http://www.afrlhorizons.com/Briefs/0012/VA0001.html (accessed Apr. 17, 2002), Associated Business Publications International, New York, New York.

Carroll, B.F., "Fundamentals of Pressure and Temperature Sensitive Paints," http://www.aero.ufl.edu/~bfc/html/body_fundamentals.htm (accessed Apr. 17, 2002), 2 pages, University of Florida, Department of Aerospace Engineering, Mechanics & Engineering Science, Gainsville, Florida.

Color Change Corporation, "Leuco Dyes," http://www.colorchange.com/tech-ld.htm (accessed Nov. 26, 2001), 2 pages, Streamwood, Illinois.

Hallcrest, Inc., "Data Sheet Listing," http://www.hallcrest.com/industrial/industrial.pdf (accessed Nov. 26, 2001), 1 page, Glenview, Illinois.

Hallcrest, Inc., "Product Overview," http://www.hallcrest.com/industrial/industrial.pdf (accessed Nov. 26, 2001), 2 pages, Glenview, Illinois, Jun. 2000.

Hallcrest, Inc., "Technology Background: The Use of TLC Products As Research Tools," http://www.hallcrest.com/industrial/industrial.pdf (accessed Nov. 26, 2001), 2 pages, Glenview, Illinois, Jun. 2000.

Hallcrest, Inc., "Color Change Properties," http://www.hallcrest.com/industrial/industrial.pdf (accessed Nov. 26, 2001), 2 pages, Glenview, Illinois, Jun. 2000.

Hallcrest, Inc., "TLC Coated Polyester Sheets," http://www.hallcrest.com/industrial/industrial.pdf (accessed Nov. 26, 2001), 2 pages, Glenview, Illinois, Mar. 2000.

Hallcrest, Inc., "Introductory Liquid Crystal Kit KT500," http://www.hallcrest.com/industrial/industrial.pdf (accessed Nov. 26, 2001), 1 page, Glenview, Illinois, Jun. 2000.

Hallcrest, Inc., "Microencapsulated TLC Slurries," http://www.hallcrest.com/industrial/industrial.pdf (accessed Nov. 26, 2001), 2 pages, Glenview, Illinois, Jun. 2000.

Hallcrest, Inc., "Sprayable TLC Coatings," http://www.hallcrest.com/industrial/industrial.pdf (accessed Nov. 26, 2001), 2 pages, Glenview, Illinois, Jun. 2000.

Hallcrest, Inc., "Ancillary Products," http://www.hallcrest.com/industrial/industrial.pdf (accessed Nov. 26, 2001), 2 pages, Glenview, Illinois, Jun. 2000.

Hallcrest, Inc., "General Application Notes," http://www.hallcrest.com/industrial/industrial.pdf (accessed Nov. 26, 2001), 1 page, Glenview, Illinois, Jun. 2000.

Hallcrest, Inc., "Literature Review: TLC Applications (1) Engineering and Aerodynamic Research; Heat Transfer and Flow Visualization Studies," http://www.hallcrest.com/industrial/industrial.pdf (accessed Nov. 26, 2001), 5 pages, Glenview, Illinois, May 1991.

Hamner, M.P. et al., "Using Temperature Sensitive Paint Technology," AIAA 2002-0742, pp. 1-20, American Institute of Aeronautics and Astronautics, Inc., Reston, Virginia, presented at 40th Aerospace Sciences Meeting & Exhibit, Jan. 14-17, 2002, Reno, Nevada.

Homola, J., "Color-Changing Inks, Brighten your bottom line," http://www.screenweb.com/inks/cont/brighten981119.html (accessed Nov. 26, 2001), 5 pages, ST Media Group International, Cincinnati, Ohio.

Hubner, J.P. et al., "Heat Transfer Measurements In Hypersonic Flow Using Luminescent Coating Techniques," AIAA 2002-0741, pp. 1-11, American Institute of Aeronautics and Astronautics, Inc., Reston, Virginia, presented at 40th Aerospace Sciences Meeting & Exhibit, Jan. 14-17, 2002, Reno, Nevada.

International Ink Company LLC, "Temp-Tell® Thermochromic Inks," http://www.iicink.com/temptell.htm (accessed Nov. 26, 2001), 3 pages, Gainesville, Georgia.

Kondo, S. et al., "Abrasive-Free Polishing for Copper Damascene Interconnection", Journal of the Electrochemical Society, vol. 147, No. 10, pp. 3907-3913, The Electrochemical Society, Inc., Pennington, New Jersey, 2000.

Lakfabriek Korthals BV, "Therm-O-Signal Temperature indicating paints," http://www.korthals.nl/e/Product/TOse.html (accessed Apr. 17, 2002), 2 pages.

Photonics Net, "Paint Glows Under Pressure," http://www.photonics.com/Content/Aug98/techPaint.html (accessed Apr. 17, 2002), 4 pages, Laurin Publishing Co., Inc., Pittsfield, Massachusetts, Aug. 1998.

Lepicovsky, J. et al., "Use of Pressure Sensitive Paint for Diagnostics In Turbomachinery Flows With Shocks," NASA/TM-2001-211111, ISABE 2001-1142, http://gltrs.grc.nasa.gov/GLTRS, pp. 1-9, National Aeronautics and Space Administration, John H. Glenn Research Center, Cleveland, Ohio, Nov. 2001, prepared for the 15th International Symposium on Airbreathing Engines, sponsored by the International Society for Airbreathing Engines, Bangalore, India, Sep. 2-7, 2001.

Hallcrest, Inc., "Literature Review: TLC Applications (3) General Thermal Mapping and Non-Destructive Testing (NDT)," http://www.hallcrest.com/industrial/industrial.pdf (accessed Nov. 26, 2001), 4 pages, Glenview, Illinois, Jan. 1996.

Bencic, T.J., "Application of Pressure-Sensitive Paint to Ice-Accreted Wind Tunnel Models," NASA/TM-2000-209942, http://gltrs.grc.nasa.gov/GLTRS, 14 pages, National Aeronautics and Space Administration, John H. Glenn Research Center, Cleveland, Ohio, Jun. 2000, prepared for the 38th Aerospace Sciences Meeting and Exhibit sponsored by the American Institute of Aeronautics and Astronautics, Reno, Nevada, Jan. 10-14, 2000.

* cited by examiner

APPARATUSES AND METHODS FOR IN-SITU OPTICAL ENDPOINTING ON WEB-FORMAT PLANARIZING MACHINES IN MECHANICAL OR CHEMICAL-MECHANICAL PLANARIZATION OF MICROELECTRONIC-DEVICE SUBSTRATE ASSEMBLIES

CROSS-REFERENCE TO RELATED APPLICATIONS

This application is a divisional of U.S. patent application Ser. No. 10/624,382, filed Jul. 21, 2004 now U.S. Pat. No. 6,986,700, issued Jan. 17, 2006, which is a divisional of U.S. patent application Ser. No. 09/589,380, filed Jun. 7, 2000, now U.S. Pat. No. 6,612,901, issued Sep. 2, 2003, both of which are incorporated herein by reference in their entireties.

TECHNICAL FIELD

The present invention relates to devices for endpointing or otherwise monitoring the status of mechanical and/or chemical-mechanical planarization of microelectronic-device substrate assemblies.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic device substrate assemblies. CMP processes generally remove material from a substrate assembly to create a highly planar surface at a precise elevation in the layers of material on the substrate assembly. FIG. 1 schematically illustrates an existing web-format planarizing machine 10 for planarizing a substrate 12. The planarizing machine 10 has a support table 14 with a top-panel 16 at a workstation where an operative portion (A) of a planarizing pad 40 is positioned. The top-panel 16 is generally a rigid plate to provide a flat, solid surface to which a particular section of the planarizing pad 40 may be secured during planarization.

The planarizing machine 10 also has a plurality of rollers to guide, position and hold the planarizing pad 40 over the top-panel 16. The rollers include a supply roller 20, idler rollers 21, guide rollers 22, and a take-up roller 23. The supply roller 20 carries an unused or pre-operative portion of the planarizing pad 40, and the take-up roller 23 carries a used or post-operative portion of the planarizing pad 40. Additionally, the left idler roller 21 and the upper guide roller 22 stretch the planarizing pad 40 over the top-panel 16 to hold the planarizing pad 40 stationary during operation. A motor (not shown) generally drives the take-up roller 23 to sequentially advance the planarizing pad 40 across the top-panel 16 along a pad travel path T—T, and the motor can also drive the supply roller 20. Accordingly, clean pre-operative sections of the planarizing pad 40 may be quickly substituted for used sections to provide a consistent surface for planarizing and/or cleaning the substrate 12.

The web-format planarizing machine 10 also has a carrier assembly 30 that controls and protects the substrate 12 during planarization. The carrier assembly 30 generally has a substrate holder 32 to pick up, hold and release the substrate 12 at appropriate stages of the planarizing process.

Several nozzles 33 attached to the substrate holder 32 dispense a planarizing solution 44 onto a planarizing surface 42 of the planarizing pad 40. The carrier assembly 30 also generally has a support gantry 34 carrying a drive assembly 35 that can translate along the gantry 34. The drive assembly 35 generally has an actuator 36, a drive shaft 37 coupled to the actuator 36, and an arm 38 projecting from the drive shaft 37. The arm 38 carries the substrate holder 32 via a terminal shaft 39 such that the drive assembly 35 orbits the substrate holder 32 about an axis B—B (arrow $R_1$). The terminal shaft 39 may also be coupled to the actuator 36 to rotate the substrate holder 32 about its central axis C—C (arrow $R_2$).

The planarizing pad 40 and the planarizing solution 44 define a planarizing medium that mechanically and/or chemically-mechanically removes material from the surface of the substrate 12. The planarizing pad 40 used in the web-format planarizing machine 10 is typically a fixed-abrasive planarizing pad in which abrasive particles are fixedly bonded to a suspension material. In fixed-abrasive applications, the planarizing solution is a "clean solution" without abrasive particles. In other applications, the planarizing pad 40 may be a non-abrasive pad composed of a polymeric material (e.g., polyurethane) or other suitable materials. The planarizing solutions 44 used with the non-abrasive planarizing pads are typically slurries with abrasive particles.

To planarize the substrate 12 with the planarizing machine 10, the carrier assembly 30 presses the substrate 12 against the planarizing surface 42 of the planarizing pad 40 in the presence of the planarizing solution 44. The drive assembly 35 then translates the substrate 12 across the planarizing surface 42 by orbiting the substrate holder 32 about the axis B—B and/or rotating the substrate holder 32 about the axis C—C. As a result, the abrasive particles and/or the chemicals in the planarizing medium remorse material from the surface of the substrate 12.

CMP processes should consistently and accurately produce a uniformly planar surface on the substrate to enable precise fabrication of circuits and photo-patterns. During the fabrication of transistors, contacts, interconnects and other features, many substrates develop large "step heights" that create highly topographic surfaces across the substrates. Such highly topographical surfaces can impair the accuracy of subsequent photolithograpllic procedures and other processes that are necessary for forming sub-micron features. For example, it is difficult to accurately focus photo patterns to within tolerances approaching 0.1 micron on topographic surfaces because sub-micron photolithograplilc equipment generally has a very limited depth of field. Thus, CMP processes are often used to transform a topographical surface into a highly uniform, planar surface at various stages of manufacturing the microelectronic devices.

In the highly competitive semiconductor industry, it is also desirable to maximize the throughput of CMP processing by producing a planar surface on a substrate as quickly as possible. The throughput of CMP processing is a function, at least in part, of the ability to accurately stop CMP processing at a desired endpoint. In a typical CMP process, the desired endpoint is reached when the surface of the substrate is planar and/or when enough material has been removed from the substrate to form discrete components (e.g., shallow trench isolation areas, contacts and damascene lines). Accurately stopping CMP processing at a desired endpoint is important for maintaining a high throughput because the substrate assembly may need to be re-polished if it is "under-planarized," or components on the substrate may be destroyed if it is "over-polished." Thus, it is highly desirable to stop CMP processing at the desired endpoint.

In one conventional method for determining the endpoint of CMP processing, the planarizing period of a particular substrate is estimated using an estimated polishing rate based upon the polishing rate of identical substrates that were planarized under the same conditions. The estimated planarizing period for a particular substrate, however, may not be accurate because the polishing rate and other variables may change from one substrate to another. Thus, this method may not produce accurate results.

In another method for determining the endpoint of CMP processing, the substrate is removed from the pad and then a measuring device measures a change in thickness of the substrate. Removing the substrate from the pad, however, interrupts the planarizing process and may damage the substrate. Thus, this method generally reduces the throughput of CMP processing.

U.S. Pat. No. 5,433,651 issued to Lustig et al. ("Lustig") discloses an in-situ chemical-mechanical polishing machine for monitoring the polishing process during a planarizing cycle. The polishing machine has a rotatable polishing table including a window embedded in the table and a planarizing pad attached to the table. The pad has an aperture aligned with the window embedded in the table. The window is positioned at a location over which the workpiece can pass for in-situ viewing of a polishing surface of the workpiece from beneath the polishing table. The planarizing machine also includes a device for measuring a reflectance signal representative of an in-situ reflectance of the polishing surface of the workpiece. Lustig discloses terminating a planarizing cycle at the interface between two layers based on the different reflectances of the materials.

Although the apparatus disclosed in Lustig is an improvement over other CMP endpointing techniques, it is not applicable to web-format planarizing applications because web-format planarizing machines have stationary support tables over which the web-format planarizing pads move. For example, if the planarizing pad in Lustig was used on a web-format machine that advances the pad over a stationary table, the single circular aperture in Lustig's planarizing pad would move out of alignment with a window in the stationary table. The planarizing pad disclosed in Lustig would then block a light beam from a reflectance or interferrometric endpointing device under the stationary table. As such, the in-situ endpointing apparatus disclosed in Lustig would not work with web-format planarizing machines.

SUMMARY OF THE INVENTION

The present invention is directed toward planarizing machines, planarizing pads, and methods for planarizing or endpointing mechanical and/or chemical-mechanical planarization of microelectronic substrates. One particular embodiment is a planarizing machine that controls the movement of a planarizing pad along a pad travel path to provide optical analysis of a substrate assembly during a planarizing cycle. The planarizing machine can include a table having a support surface with a first dimension extending along the pad travel path, a second dimension transverse to the first dimension, a planarizing zone within the first and second dimensions, and an optical opening at an illumination site in the planarizing zone. The planarizing machine can also include a light source aligned with the illumination site to direct a light beam through the optical opening in the table.

The planarizing machine further includes a planarizing pad and a pad advancing mechanism. The planarizing pad has a planarizing medium and at least one optically transmissive window along the pad travel path. In a typical embodiment, the planarizing pad includes a plurality of optically transmissive windows arranged in a line along the pad travel path. The pad advancing mechanism generally has an actuator system coupled to the planarizing pad and a position monitor coupled to the actuator system. The actuator system is configured to move the planarizing pad over the table along the pad travel path, and the position monitor is configured to sense the position of a window in the planarizing pad relative to the opening in the table at the illumination site. The position monitor can be an optical, mechanical, or electrical system that works in combination with either the windows in the planarizing pad or other features of the planarizing pad to sense the position of the windows relative to the opening.

The planarizing machine can further include a carrier assembly having a head and a drive mechanism connected to the head. The head is configured to hold a substrate assembly during a planarizing cycle. The drive mechanism generally moves the head and the substrate assembly with respect to the planarizing pad during a planarizing cycle to rub the substrate assembly against the planarizing pad. The drive mechanism is generally coupled to the actuator of the advancing mechanism to coordinate the movement of the planarizing pad along the pad travel path T—T in conjunction with input signals from the position monitor so that a window of the planarizing pad is aligned with the opening at the illumination site during a planarizing cycle.

DETAILED DESCRIPTION

The following description discloses planarizing machines and methods for endpointing or otherwise controlling mechanical and/or chemical-mechanical planarization of microelectronic-device substrates in accordance with several embodiments of the invention. The terms "substrate" and "substrate assembly" refer to semiconductor wafers, field emission displays and other types of microelectronic manufacturing formats either before or after microelectronic components are formed on the substrates. Many specific details of the invention are described below and shown in FIGS. 2–8 to provide a thorough understanding of such embodiments. Several aspects of the present invention, however, may be practiced using other types of planarizing machines. A person skilled in the art will thus understand that the invention may have additional embodiments, or that the invention may be practiced without several of the details described below.

Figure 2:
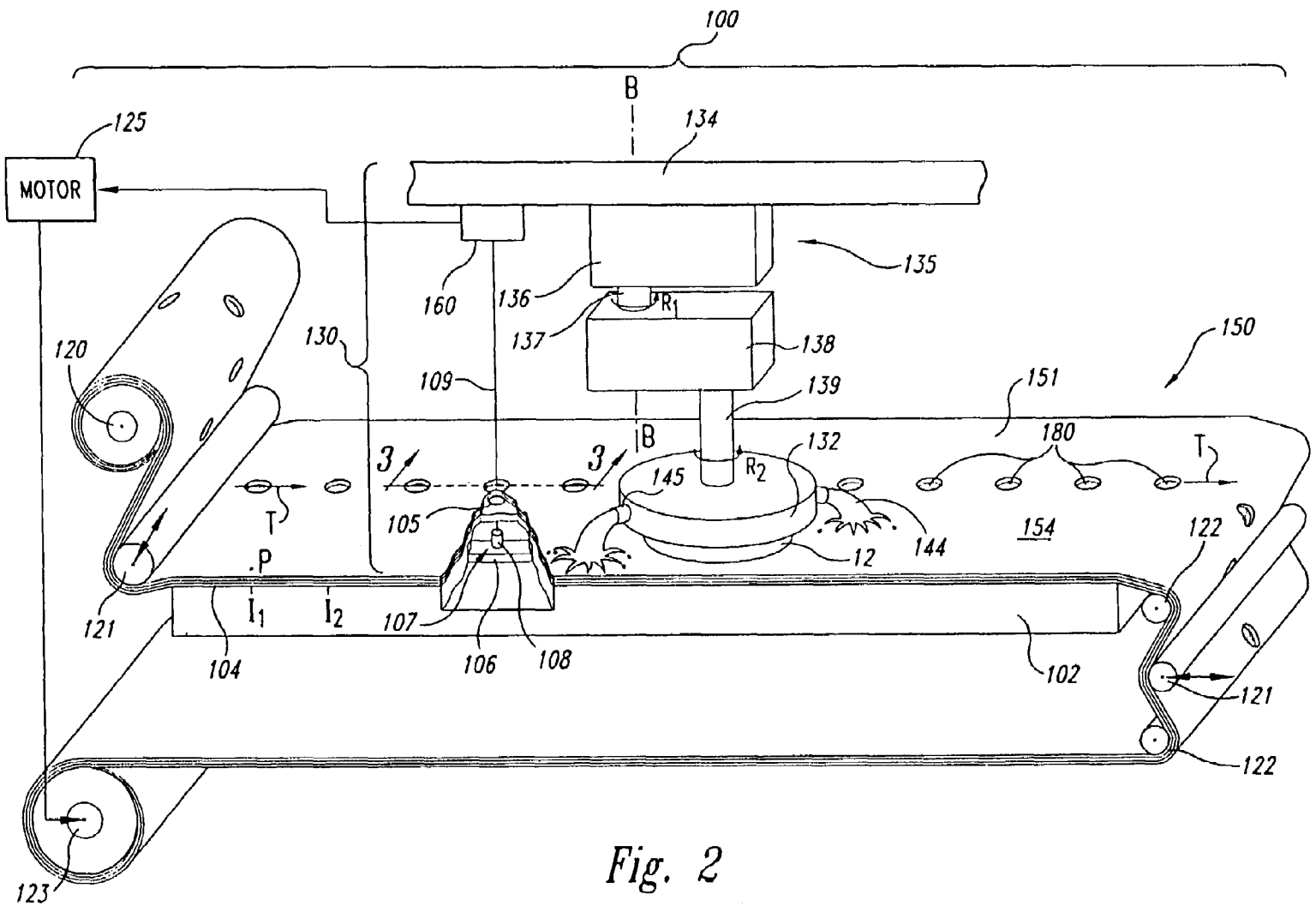
FIG. 2 is a partially schematic isometric view of a web-format planarizing machine with a web-format-planarizing pad in accordance with an embodiment of the invention.

FIG. 2 is a partially schematic isometric view of a web-format planarizing machine 100 including an optical reflectance system 107 and a position monitor 160 in accordance with one embodiment of the invention. The planarizing machine 100 has a table 102 including a stationary support surface 104, an opening 105 at an illumination site in the support surface 104, and a shelf 106 under the support surface 104. The planarizing machine 100 also includes an optical emitter/sensor 108 mounted to the shelf 106 at the illumination site. The optical emitter/sensor 108 projects a light beam 109 through the opening 105 in the support surface 104. The optical emitter/sensor 108 can be a reflectance device that emits the light beam 109 and senses a reflectance to determine the surface condition of a substrate 12 in-situ and in real time. Reflectance and interferometer endpoint sensors that may be suitable for the optical emitter/sensor 108 are disclosed in U.S. Pat. Nos. 5,865,665; 5,648,847; 5,337,144; 5,777,739; 5,663,797; 5,465,154; 5,461,007; 5,433,651; 5,413,941; 5,369,488; 5,324,381; 5,220,405; 4,717,255; 4,660,980; 4,640,002 4,422,764; 4,377,028; 5,081,796; 4,367,044; 4,358,338; 4,203,799; and 4,200,395; and U.S. application Ser. Nos. 09/066,044 and 09/300,358, now U.S. Pat. Nos. 6,075,606 and 6,213,845, respectively; all of which are herein incorporated by reference.

Figure 1:
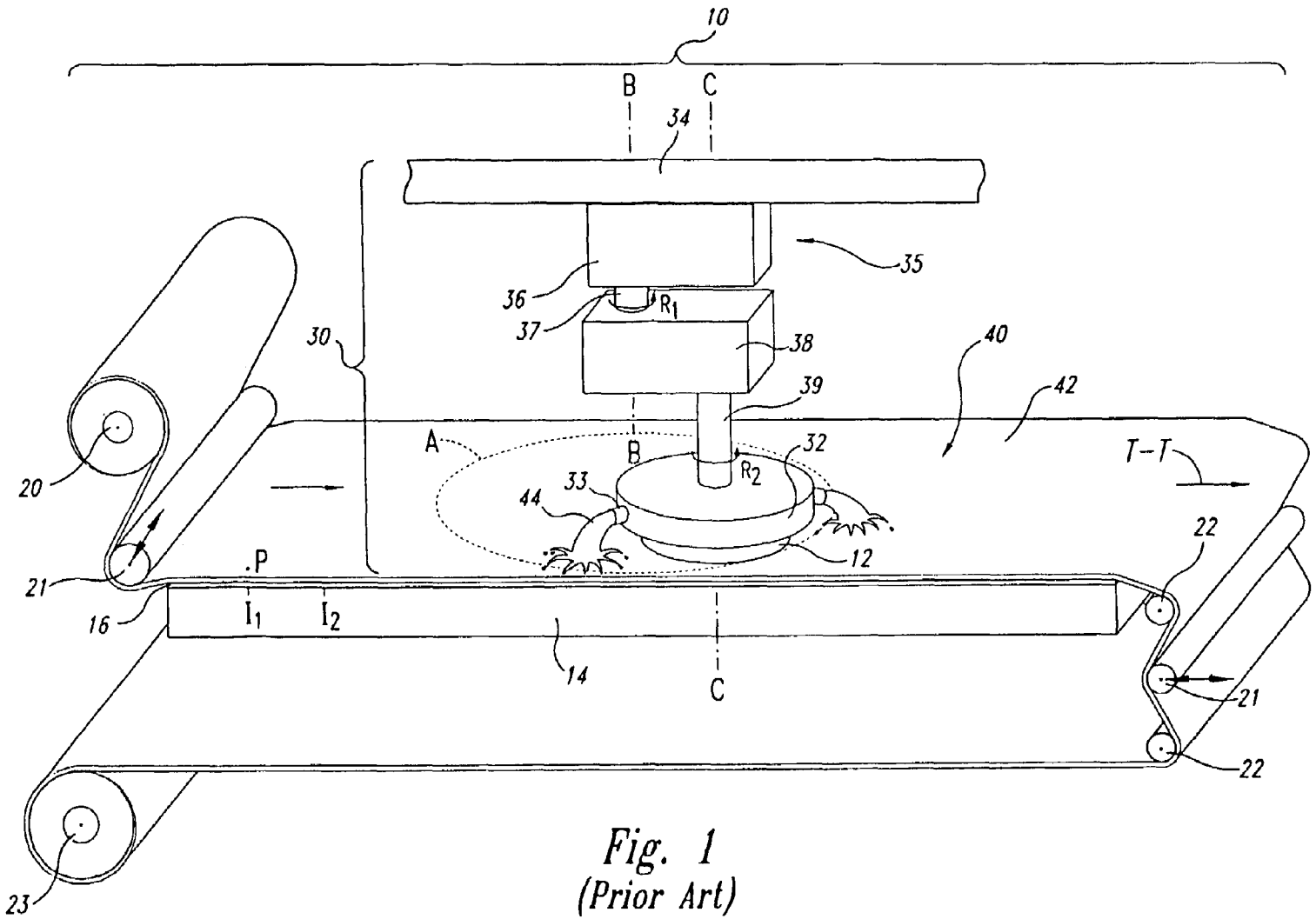
Fig. 1 (Prior Art)
FIG. 1 is a partially schematic isometric view of a web-format planarizing machine in accordance with the prior art.

The planarizing machine 100 can further include a pad advancing mechanism having a plurality of rollers 120, 121, 122 and 123 that are substantially the same as the roller system described above with reference to the planarizing machine 10 in FIG. 1. In this embodiment, an actuator or motor 125 is coupled to the take-up roller 123 to pull a web-format pad 150 along the pad travel path T—T. Additionally, the planarizing machine 100 can include a carrier assembly 130 that is substantially the same as the carrier assembly 30 described above with reference to FIG. 1.

The planarizing pad 150 has a planarizing medium 151 with a planarizing surface 154. The planarizing medium 151 can be an abrasive or a non-abrasive material. For example, an abrasive planarizing medium 151 can have a resin binder and abrasive particles distributed in the resin binder. Suitable abrasive planarizing mediums 151 are disclosed in U.S. Pat. Nos. 5,645,471; 5,879,222; 5,624,303; and U.S. patent application Ser. Nos. 09/164,916 and 09/001,333, now U.S. Pat. Nos. 6,039,633 and 6,139,402, respectively, all of which are herein incorporated by reference.

Figure 3:
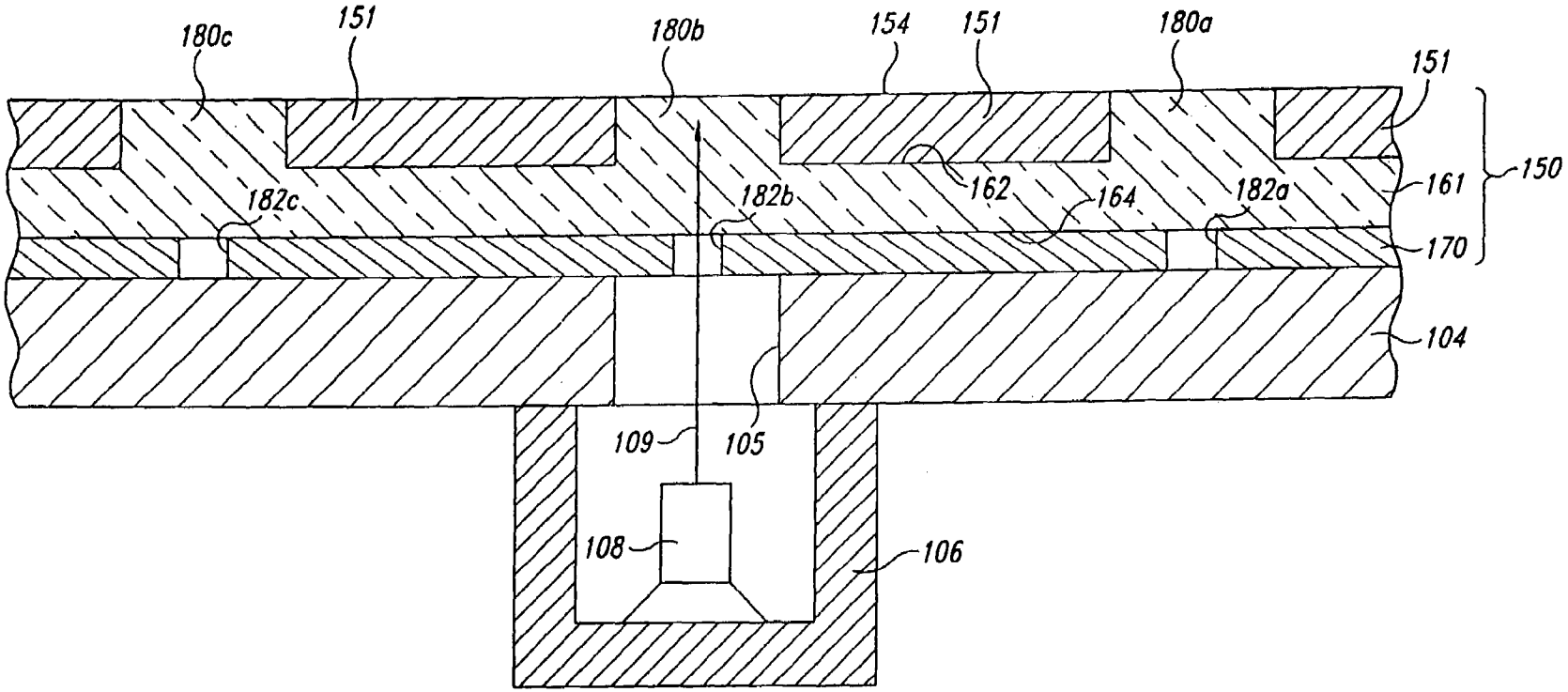
FIG. 3 is a cross-sectional view partially showing the planarizing machine and the planarizing pad of FIG. 2.

FIG. 3 is a cross-sectional view partially illustrating the web-format planarizing pad 150 and the optical emitter/sensor 108 in greater detail. This embodiment of the planarizing pad 150 also includes an optically transmissive backing sheet 161 under the planarizing medium 151 and a resilient backing pad 170 under the backing sheet 161. The planarizing medium 151 can be disposed on a top surface 162 of the backing sheet 161, and the backing pad 170 can be attached to an under surface 164 of the backing sheet 161. The backing sheet 161 for example, can be a continuous sheet of polyester (e.g., Mylar®) or polycarbonate (e.g., Lexan®). The backing pad 170 can be a polyurethane or other type of compressible material. In one particular embodiment, the planarizing medium 151 is an abrasive material having abrasive particles, the backing sheet 161 is a long continuous sheet of Mylar, and the backing pad 170 is a compressible polyurethane foam. In other embodiments, the planarizing pad 150 has only one of the backing sheet 161 or the backing pad 170 without the other.

Referring to FIGS. 2 and 3 together, the planarizing pad 150 also has an optical pass-through system to allow the light beam 109 to pass through the pad 150 and illuminate an area on the bottom face of the substrate 12 irrespective of whether a point P on the pad 150 is at position $I_1$, $I_2$ . . . or $I_n$ (FIG. 2). In this embodiment, the optical pass-through system includes a first plurality of windows 180 in the planarizing medium 151 and a second plurality of orifices 182 (FIG. 3) through the backing pad 170. The windows 180 and the orifices 182 are arranged in a line extending generally parallel to the pad travel path T—T (FIG. 2). For example, as best show in FIG. 3, the optical pass-through system of this embodiment includes discrete windows 180*a–c* in the planarizing medium 151 and corresponding discrete orifices 182*a–c* in the backing pad 170. Each orifice 182 in the backing pad 170 is aligned with a corresponding window 180 in the planarizing medium 151, and each pair of an aligned window 180 and an orifice 182 defines a view sight of the optical pass-through system for the planarizing pad 150. As a result, the light beam 109 can pass through the planarizing pad 150 when a window 180 is aligned with the illumination sight.

The embodiment of the planarizing pad 150 shown in FIGS. 2 and 3 allows the optical emitter/sensor 108 to detect the reflectance 109 from the substrate 12 in-situ and in real time during a planarizing cycle on the web-format planarizing machine 100. In operation, the carrier assembly 130 moves the substrate 12 across the planarizing surface 154 as a planarizing solution 144 (FIG. 2) flows onto the planarizing pad 150. The planarizing solution 144 is generally a clear, non-abrasive solution that does not block the light beam 109 or its reflectance from passing through the window 180*b* aligned with the illumination site. As the carrier assembly 130 moves the substrate 12, the light beam 109 passes through both the optically transmissive backing sheet 161 and the window 180*b* to illuminate the face of the substrate 12. The reflectance returns to the optical emitter/sensor 108 through the window 180*b*. The optical emitter/sensor 108 thus detects the reflectance from the substrate 12 throughout the planarizing cycle.

Referring to FIG. 2, the position monitor 160 is coupled to the motor 125 of the advancing mechanism. The position monitor 160 is generally configured to sense the position of the windows 180 relative to the opening 105 in the support surface 104. The position monitor 160 can include a switch or a signal generator that controls the motor 125 to position one of the windows 180 over the opening 105. For example, the position monitor 160 can include a switch that deactivates the motor 125 when the position monitor 160 senses that a window 180 is aligned with the opening 105. The position monitor 160 or another component of the planarizing machine 100, such as the carrier system 130, can reactivate the motor 125 after a planarizing cycle to move the planarizing pad 150 along the pad travel path T—T. The position monitor 160 can accordingly include the appropriate hardware or software to deactivate the motor 125 as the next window 180 is aligned with the opening 105.

In the particular embodiment of the planarizing machine 100 shown in FIGS. 2 and 3, the position monitor 160 is an optical sensor configured to receive the light beam 109 when a window 180 is at the illumination site. The position monitor 160 preferably generates a signal when it detects the light beam 109 to deactivate the motor 125. The position monitor 160 can have several other embodiments that sense when one of the windows 180 is aligned with the opening 105 using optical, mechanical, or electrical sensing mechanisms.

Figure 4:
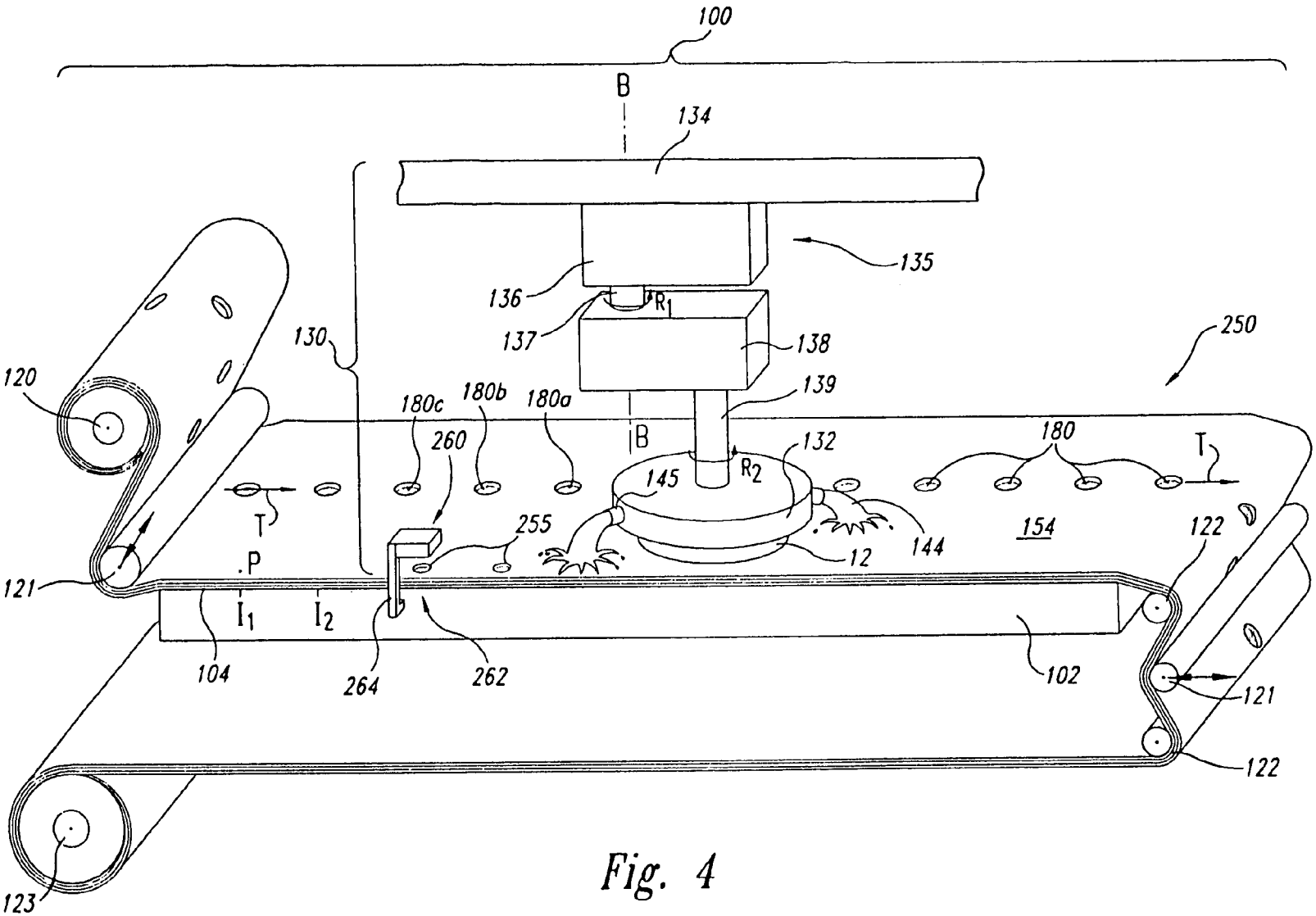
FIG. 4 is a partially schematic isometric view of a web-format planarizing machine in accordance with another embodiment of the invention.

FIG. 4 is an isometric view of another embodiment of the web-format planarizing machine 100 having a planarizing pad 250 and position monitor 260 in accordance with another embodiment of the invention. The planarizing pad 250 can include a plurality of windows 180 and a plurality of corresponding optical ports 255 spaced apart from the windows 180. The optical ports 255 can be configured relative to the windows 180 so that one of the optical ports 255 is located at a position monitoring site 262 when a corresponding window 180 is located at the illumination site on the table. The position monitoring site 262 and the illumination site are generally fixed points on the table 104. The optical ports 255 are preferably positioned outside of a planarizing zone defined by the contact area between the substrate 12 and the planarizing surface of the planarizing pad 250.

The position monitor 260 shown in FIG. 4 is an optical sensor attached to the table 104 by a leg 264. The optical sensor 260 in this embodiment senses the reflectance of ambient light from the table 104 through the optical ports 255. As such, when a window 180 is aligned with the illumination site, the sensor 260 senses the reflectance of ambient light through a corresponding optical port 255 at the position monitoring site 262. The optical sensor 260 can accordingly deactivate a motor (not shown in FIG. 4) or other type of actuator coupled to the planarizing pad 250 to stop the planarizing pad 250 from moving over the table 104 along the pad trammel path T—T.

Figure 5A:
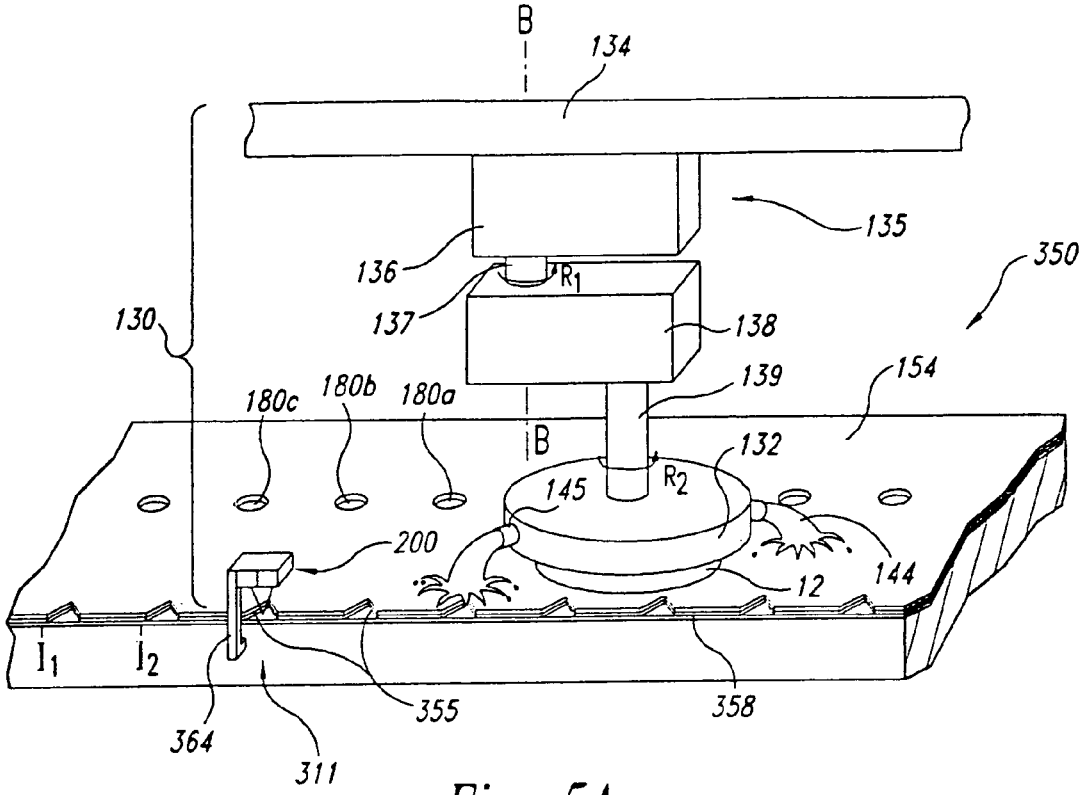
FIG. 5A is a partially schematic isometric view of a web-format planarizing machine in accordance with another embodiment of the invention.
Figure 5B:
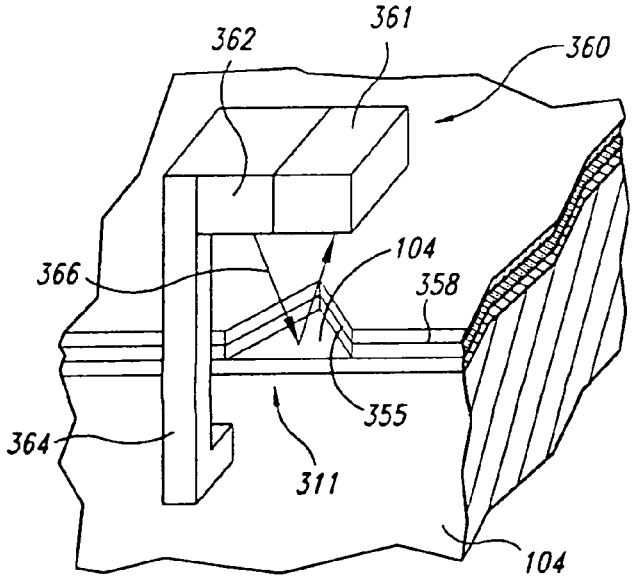
FIG. 5B is a detailed isometric view of a portion of the planarizing machine of FIG. 5A.

FIG. 5A is an isometric view of another planarizing machine 100 having a position monitor 360 and a planarizing pad 350 in accordance with another embodiment of the invention. In this embodiment, the planarizing pad 350 has a plurality of windows 180 and a plurality of optical ports 355. The optical ports 355, for example, can be notches or indents arranged in a second line along an edge 358 of the pad 350 so that one of the optical ports 355 is located at a position monitoring site 311 when a corresponding window 180 is located at the illumination site. Referring to FIG. 5B, the position monitor 360 includes an optical sensor 361 and a light source 362 that are mounted to the table 104 by a leg 364. The light source 362 emits a light beam 366 that reflects off of the table 104 when one of the optical ports 355 is at the position monitoring site 311. The optical sensor 361, accordingly, senses the light beam 366 when a window 180 is aligned with the illumination site.

Figure 6A:
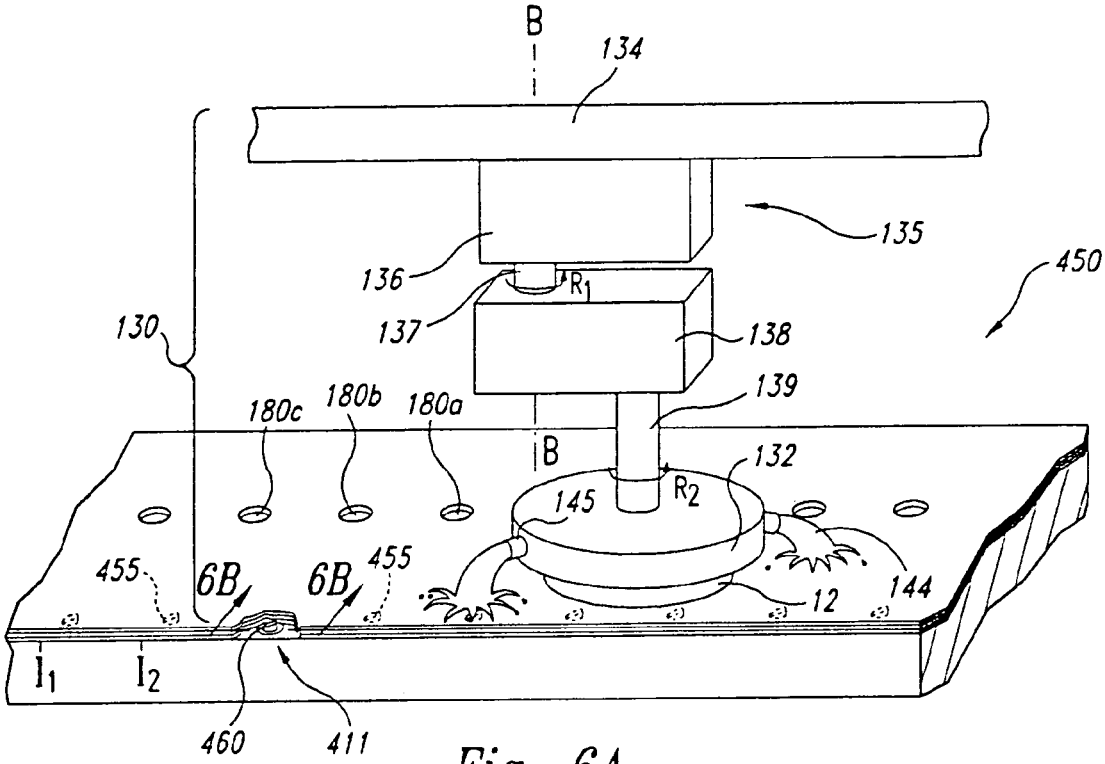
FIG. 6A is a partially schematic isometric view of a web-format planarizing machine in accordance with another embodiment of the invention.

FIG. 6A is an isometric view of another planarizing machine 100 having a planarizing pad 450 and a position monitor 460 in accordance with another embodiment of the invention. The planarizing pad 450 can include a plurality of windows 180 and a plurality of contour elements defined by a number of indents 455 (shown in broken lines) on the bottom side of the planarizing pad 450. The indents 455 are arranged in a pattern relative to the windows 180 so that one of the indents 455 is located at a position monitoring site 411 when a corresponding window 180 is located at the illumination site. A contour element is a feature of the planarizing pad 450 that periodically varies the contour of the back side, front side, or an edge of the planarizing pad 450 in a pattern corresponding to the pattern of windows 180.

Figure 6B:
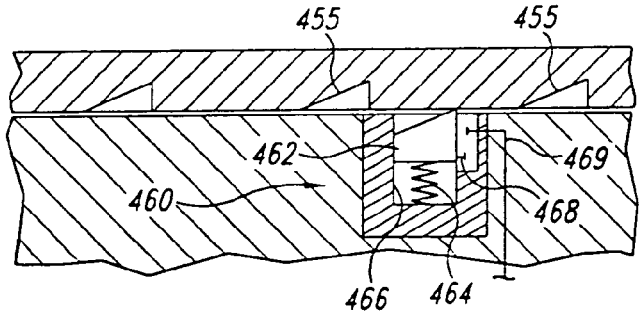
FIGS. 6B and 6C are cross-sectional views showing a portion of the planarizing machine of 6A along line 6—6.
Figure 6C:
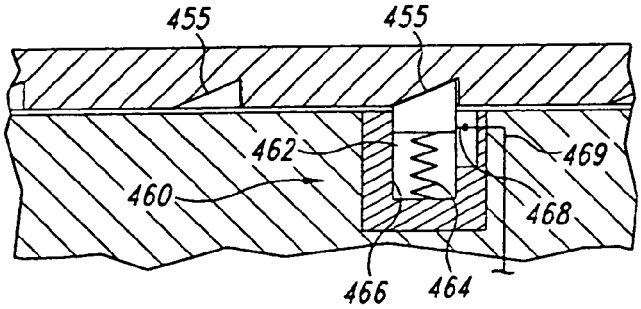
Figure 7:
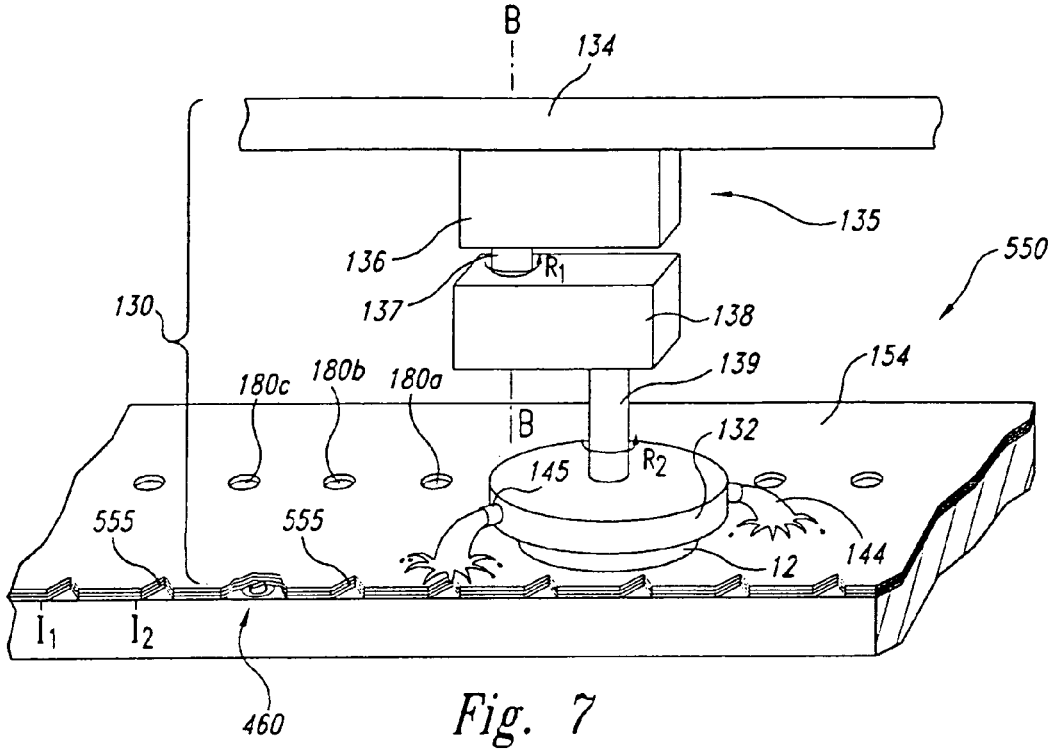
FIG. 7 is a partially schematic isometric view of a web-format planarizing machine in accordance with another embodiment of the invention.

FIGS. 6B and 6C are partial cross-section views of the planarizing pad 450 and the position monitor 460. In this embodiment, the indents 455 have a sloping face and the position monitor 460 is a mechanical displacement sensor having a probe 462 and a biasing element 464. The position monitor 460 can also include a first contact 468 coupled to the probe 462 and a second contact 469 coupled to the motor 125 (shown in FIG. 2). Referring to FIG. 6C, the biasing element 464 drives the probe 462 upwardly through a cylinder 466 when an indent 455 passes over the position monitor 460. The first contact 468 accordingly contacts the second contact 469 to generate a signal or to complete a circuit that deactivates the motor 125.

FIG. 7A is an isometric view of another planarizing machine 100 having the position monitor 460 described above and a planarizing pad 550 in accordance with another embodiment of the invention. In this embodiment, the planarizing pad 550 has a plurality of contour elements defined by notches 555. The notches 555 are arranged in a pattern corresponding to the pattern of windows 180 so that one of the notches 555 is positioned over the position monitor 460 when a corresponding window 180 is positioned at the illumination site. The position monitor 460 accordingly operates in the same manner as explained above with reference to FIG. 6C.

Figure 8:
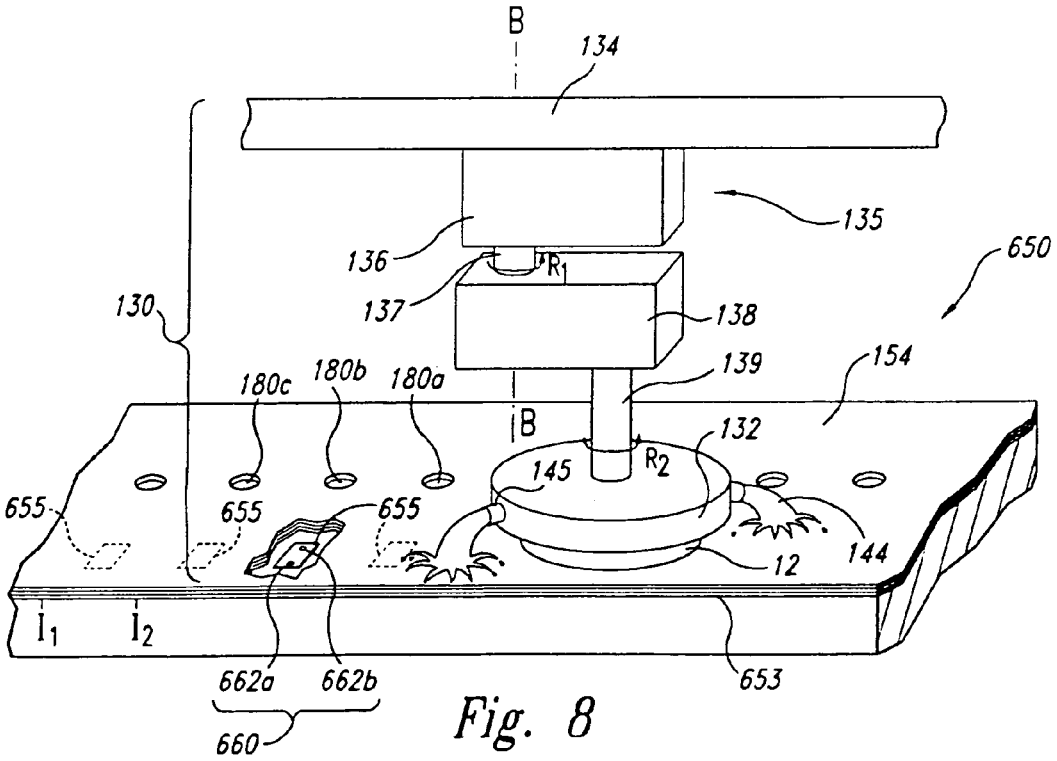
FIG. 8 is a partially schematic isometric view of a web-format planarizing machine in accordance with another embodiment of the invention.

FIG. 8 is an isometric views of the planarizing machine 100 having a planarizing pad 650 and a position monitor 660 in accordance with another embodiment of the invention. In this embodiment, the planarizing pad 650 has a backing member 653 and a plurality of electrically conductive contact features 655 in the backing member 653. The contact features 655 are arranged in a pattern corresponding to the pattern of windows 180. The contact features 655, for example, can be metal plates arranged so that a contact feature 655 is over the position monitor 660 when a corresponding window 180 is at the illumination site. The position monitor 660 can include a first conductive element 662*a* and a second conductive element 662*b*. The first conductive element 662*a* can be connected to a power source and the second conductive element 662*b* can be coupled to the motor 125 (FIG. 2). Accordingly, when a window 180 is aligned with the illumination site, a corresponding contact feature 655 completes a circuit through the position monitor 660 that deactivates the motor to stop the movement of the planarizing pad 650 along the pad travel path T—T. The contact features 655 can have other embodiments or be positioned on the edge of the planarizing pad 650 in other embodiments.

The embodiments of the planarizing machine 100 with the various planarizing pads and position monitors shown in FIGS. 2–8 provide accurate positioning of web-format planarizing pads to optically monitor the performance of the planarizing cycle through the windows 180. The position monitors ensure that the pad advancing mechanisms stop the movement of the planarizing pad to properly align a window with the optical emitter/sensor under the table. As such, the planarizing machines are expected to eliminate errors in the pad advancing mechanism that can develop over time or be caused by input errors.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

The invention claimed is:

1. A method for planarizing a microelectronic-device substrate assembly, comprising:

positioning an optically transmissive window in a planarizing pad in alignment with a first light beam of an endpointing system by moving the planarizing pad along a pad travel path, sensing when the window is aligned with the light beam, and, in response to the sensing, stopping the planarizing pad from moving further along the pad travel path; and after stopping, removing material from a microelectronic-device substrate by pressing the substrate against a planarizing surface of the planarizing pad and moving the substrate and/or the planarizing pad in a planarizing plane.

2. The method of claim 1 wherein sensing when the window is aligned with the light beam comprises directing the light beam through the window to an optical sensor configured to receive the light beam when the window is aligned with the first light beam.

3. The method of claim 1 wherein sensing when the window is aligned with the light beam comprises detecting a reflection of ambient light from a position monitoring site on a table supporting the planarizing pad through an optical port in the pad, the port being spaced apart from the window.

4. The method of claim 1 wherein sensing when the window is aligned with the light beam comprises detecting a change in contour of the planarizing pad at a contour element spaced apart from the window.

5. The method of claim 4 wherein the contour element comprises an indent on a backside of the planarizing pad arranged to be at a position monitoring site on a table supporting the planarizing pad when the window is aligned with the beam, and detecting a change in contour of the planarizing pad comprises biasing a probe of a displacement sensor into the indent when the window is aligned with the beam.

6. The method of claim 4 wherein the contour element comprises a notch along an edge of the planarizing pad arranged to be at a position monitoring site on a table supporting the planarizing pad when the window is aligned with the beam, and detecting a change in contour of the planarizing pad comprises biasing a probe of a displacement sensor into the notch when the window is aligned with the beam.

7. The method of claim 1 wherein sensing when the window is aligned with the light beam comprises engaging a conductive feature on the planarizing pad with a first electrical contact and a second electrical contact to electrically deactivate an actuator coupled to the pad when the window is aligned with the beam.

8. A method of endpointing mechanical or chemical-mechanical planarization processing of microelectronic-device substrate assemblies, comprising:

initially passing a light beam from an illumination site in a table through a first optically transmissive window in a planarizing pad to at least periodically impinge a first substrate assembly with the light beam and optically sense a surface condition of the first substrate assembly;

advancing the planarizing pad relative to the table and the illumination site after planarizing the first substrate assembly;

stopping the advancement of the planarizing pad by sensing the light beam passing through a second optically transmissive window in the planarizing pad spaced apart from the first window in a direction generally parallel to the pad travel path; and subsequently passing a light beam from the illumination site in the table through the second optically transmissive window in the planarizing pad to at least periodically impinge a second substrate assembly with the light beam and optically sense a surface condition of the second substrate assembly.

9. The method of claim 8 wherein sensing the light beam comprises directing the light beam through the second window to an optical sensor configured to receive the light beam when the second window is aligned with the light beam.

10. A method for planarizing a microelectronic-device substrate assembly, comprising:

positioning an optically transmissive window in a planarizing pad in alignment with a first light beam of an endpointing system by moving the planarizing pad along a pad travel path, sensing when the window is aligned with the light beam, and stopping the planarizing pad from moving further along the pad travel path, and wherein sensing when the window is aligned with the light beam includes detecting a reflection of ambient light from a position monitoring site on a table supporting the planarizing pad through an optical port in the pad, the port being spaced apart from the window; and removing material from a microelectronic-device substrate by pressing the substrate against a planarizing surface of the planarizing pad and moving the substrate and/or the planarizing pad in a planarizing plane.

11. A method for planarizing a microelectronic-device substrate assembly, comprising:

positioning an optically transmissive window in a planarizing pad in alignment with a first light beam of an endpointing system by moving the planarizing pad along a pad travel path, sensing when the window is aligned with the light beam, and stopping the planarizing pad from moving further along the pad travel path, and wherein sensing when the window is aligned with the light beam comprises detecting a change in contour of the planarizing pad at a contour element spaced apart from the window; and removing material from a microelectronic-device substrate by pressing the substrate against a planarizing surface of the planarizing pad and moving the substrate and/or the planarizing pad in a planarizing plane.

12. The method of claim 11 wherein the contour element comprises an indent on a backside of the planarizing pad arranged to be at a position monitoring site on a table supporting the planarizing pad when the window is aligned with the beam, and detecting a change in contour of the planarizing pad comprises biasing a probe of a displacement sensor into the indent when the window is aligned with the beam.

13. The method of claim 11 wherein the contour element comprises a notch along an edge of the planarizing pad arranged to be at a position monitoring site on a table supporting the planarizing pad when the window is aligned with the beam, and detecting a change in contour of the planarizing pad comprises biasing a probe of a displacement sensor into the notch when the window is aligned with the beam.

14. A method for planarizing a microelectronic-device substrate assembly, comprising:

positioning an optically transmissive window in a planarizing pad in alignment with a first light beam of an endpointing system by moving the planarizing pad along a pad travel path, sensing when the window is aligned with the light beam, and stopping the planarizing pad from moving further along the pad travel path, and wherein sensing when the window is aligned with the light beam comprises engaging a conductive feature on the planarizing pad with a first electrical contact and a second electrical contact to electrically deactivate an actuator coupled to the pad when the window is aligned with the beam; and removing material from a microelectronic-device substrate by pressing the substrate against a planarizing surface of the planarizing pad and moving the substrate and/or the planarizing pad in a planarizing plane.

* * * * *